US007886717B2

(12) United States Patent
Rettig et al.

(10) Patent No.: US 7,886,717 B2
(45) Date of Patent: Feb. 15, 2011

(54) FUEL INJECTOR AND FUEL-INJECTION SYSTEM

(75) Inventors: Ingo Rettig, Schwieberdingen (DE); Martin Scheffel, Vaihingen (DE); Anh-Tuan Hoang, Tamm (DE); Martin Buehner, Backnang (DE); Andreas Eckbauer, Nuremberg (DE)

(73) Assignee: Robert Bosch GmbH, Stuttgart (DE)

( * ) Notice: Subject to any disclaimer, the term of this patent is extended or adjusted under 35 U.S.C. 154(b) by 71 days.

(21) Appl. No.: 12/304,684

(22) PCT Filed: Oct. 1, 2007

(86) PCT No.: PCT/EP2007/060352

§ 371 (c)(1),
(2), (4) Date: Jun. 5, 2009

(87) PCT Pub. No.: WO2008/064941

PCT Pub. Date: Jun. 5, 2008

(65) Prior Publication Data

US 2009/0260597 A1 Oct. 22, 2009

(30) Foreign Application Priority Data

Nov. 30, 2006 (DE) ..... 10 2006 056 704

(51) Int. Cl.
*F02M 61/14* (2006.01)

(52) U.S. Cl. ..... 123/470

(58) Field of Classification Search ..... 123/470
See application file for complete search history.

(56) References Cited

U.S. PATENT DOCUMENTS

| | | | | |
|---|---|---|---|---|
| 6,655,356 | B2 * | 12/2003 | Lippert | 123/470 |
| 6,684,860 | B2 * | 2/2004 | Baessler et al. | 123/470 |
| 6,718,949 | B2 * | 4/2004 | Gmelin | 123/470 |
| 6,745,752 | B1 | 6/2004 | Jensen et al. | |
| 6,772,736 | B2 * | 8/2004 | Liskow | 123/470 |
| 6,830,037 | B1 | 12/2004 | Braun et al. | |
| 6,840,227 | B2 * | 1/2005 | Reiter et al. | 123/470 |

(Continued)

FOREIGN PATENT DOCUMENTS

DE 197 35 665 1/1999

(Continued)

OTHER PUBLICATIONS

International Search Report, PCT/EP2007/060352 dated Mar. 5, 2008.

*Primary Examiner*—Thomas N Moulis
(74) *Attorney, Agent, or Firm*—Kenyon & Kenyon LLP

(57) ABSTRACT

A fuel injector, especially for the direct injection of fuel into a combustion chamber of an internal combustion engine, includes a nozzle body able to be inserted into a recess of a cylinder head, a valve housing, a plug abutting the valve housing, and at least one fixation element, which fixes the nozzle body in its position in the recess, the fixation element extending from a connection region (28) between the valve housing and the plug on the spray-discharge side. The at least one fixation element has a reinforcement having a spherical contour at an outer periphery, the reinforcement being formed by at least one outwardly projecting element having an outwardly curving end face and/or having a planar end face.

18 Claims, 6 Drawing Sheets

U.S. PATENT DOCUMENTS

| | | | | |
|---|---|---|---|---|
| 7,461,638 | B2 * | 12/2008 | Scheffel et al. | 123/470 |
| 7,765,984 | B2 * | 8/2010 | Fuerst et al. | 123/456 |
| 2003/0131824 | A1 | 7/2003 | Mahr et al. | |
| 2004/0089263 | A1 | 5/2004 | Herden et al. | |

FOREIGN PATENT DOCUMENTS

| | | |
|---|---|---|
| DE | 101 59 908 | 6/2003 |
| GB | 2 325 024 | 11/1998 |
| WO | WO 02/44540 | 6/2002 |

* cited by examiner

FUEL INJECTOR AND FUEL-INJECTION SYSTEM

FIELD OF THE INVENTION

The present invention is based on a fuel injector and on a fuel-injection system.

BACKGROUND INFORMATION

Since only a small number of high-pressure injection valves actually spray-discharge the fuel jet along the extension of the longitudinal valve axis, but the spray is usually inclined relative to the longitudinal valve axis, the spray orifices usually being disposed asymmetrically in addition, it is important to fix the high-pressure injector in place inside the cylinder head into which it is inserted in a manner that prevents a rotation of the valve and ensures that the spray angle always conforms to the layout.

Conventional approaches for the fixation of a high-pressure injector in a cylinder head include, for example, the provision of a rib on one section of the outer periphery of the valve body to be inserted into the cylinder head, which rib then engages with a groove correspondingly provided in the cylinder head. However, this requires the groove to be cut into the cylinder head. In addition, due to the lack of space, guide bevels to facilitate the insertion of the valve during installation in the cylinder head are unable to be provided in the region where the rib engages with the cut groove. Because such guide bevels are lacking, the installation of the high-pressure injector in the cylinder head becomes more difficult, and an installation of an FCA, i.e., a rail in which a plurality of valves are already installed, in which case all high-pressure valves with the rail must then be installed in the cylinder head simultaneously, is even next to impossible or at least not suitable for mass production since all valves must be readjusted according to their position during the installation.

Another solution for the positional fixation of a high-pressure injector in a cylinder head is the known use of a holding-down clamp, which then transmits the position to the rail and to the cylinder head.

However, a transmission of the position from the high-pressure injector to the holding-down clamp and then to the rail is possible only if the use of a corresponding holding-down clamp is an option, and if a corresponding cut—in this case, a width over flats of hexagonal nuts—is provided.

A fuel-injection system for the direct injection of fuel into a combustion chamber of an internal combustion engine is described in DE 197 35 665, for example, in which a receiving bore for each fuel injector is provided in the cylinder head to accommodate the spray-discharge section of the fuel injector, the receiving bore terminating in the associated combustion chamber. The receiving bore is implemented in the form of a stepped bore and has a tapering section against which a first sealing element rests in sealing manner and seals the spray-discharge section from the cylinder head. The fuel injector is supported on the first sealing element, which is implemented as O-ring, in a manner allowing rotation, in such a way that the fuel injector is able to pivot slightly within specified limits about a solid angle $\alpha$. The system described in DE 197 35 665 allows the fuel injector to be tilted relative to the longitudinal axle within solid angular range $\alpha$, a clamping shoe making it possible to transmit sufficient holding-down force to the fuel injector within the entire tilting range. The fuel injectors are rigidly fixed in place on the cylinder head by tightening clamping bolts of the clamping shoes, which can be screwed into the cylinder head.

However, conventional approaches for the fixation of the high-pressure injectors have the disadvantage that their implementation entails expensive cutting processes.

SUMMARY

In contrast, the fuel injector according to example embodiments of the present invention and the fuel-injection system according to example embodiments of the present invention have the advantage of providing a cost-effective approach for the fixation of the fuel injector in a cylinder head, which, for one, also ensures adequate insertion bevels for an uncomplicated installation of the individual high-pressure injectors and of an FCA, and, for another, precise positioning of the valve.

Example embodiments of the present invention provide a fixation element, which holds the nozzle body in position in the first recess, and which is realized in the form of a reinforced region having a spherical contour. The fixation element includes outwardly curved end faces and/or planar end faces. The cylinder head has a corresponding second recess in the form of an elongated hole into which the fixation element is able to be inserted. For example, the fixation element may preferably be provided as extruded pin on the outer periphery of the valve housing, which pin then engages with the bore or recess in the cylinder head (or with the rail) and thereby securely fixes the fuel injector in place.

The longitudinal axis of the fixation element is provided essentially coaxially to the longitudinal axis of the fuel injector.

The spherical contour of the fixation element preferably has a back taper above the spherical contour, so that canting of this anti-rotation fixation in the form of the fixation element, and thus its breakage, is prevented.

Moreover, it is especially advantageous if the anti-rotation fixation in the form of the fixation element tapers below the spherical contour in a downward direction, i.e., in the direction of the spray-discharge side of the fuel injector, in order to provide what is referred to as an insertion bevel to facilitate the installation of the high-pressure injector.

If the fuel injector is normally not installed with an intermediate sleeve to the rail, such sleeve serving as compensating element, then the provision of the elongated hole, or the elongated hole open on one side, in the cylinder head is especially advantageous. To compensate for tolerances between the rail cup and the cylinder head bore, the high-pressure injector must be tilted slightly. This tilting causes a movement in the anti-rotation fixation. Therefore, it is important that enough space is available in the radial direction so that the radial movement of the valve by the tolerance compensation will not lead to a transverse force (torque bias) on the anti-rotation fixation or on the fixation element.

This is achievable by selecting a round design for the recess or bore in the cylinder head but using a diameter that is considerably larger than the fixation element acting as anti-rotation fixation. However, such a design would result in considerable play in the center position and thus lead to great spray deviation. In contrast, designing the recess or bore as elongated hole is especially advantageous because the necessary installation play between the cylinder-head bore and the anti-rotation fixation is independent of the deflection between rail cup and cylinder-head bore. Thus, the installation play between the cylinder head bore or recess and the anti-rotation fixation in the form of the fixation element is able to be kept constant and especially small. In addition, this type of design has an especially advantageous effect on the spray tolerances.

Moreover, it is advantageous that the fuel injector is a multi-hole valve having asymmetrically distributed spray orifices, and that the fuel jet spray-discharged through the spray orifices is inclined relative to the longitudinal valve axis.

In addition, it is advantageous if the bore or the recess with which the anti-rotation fixation or the at least one fixation element engages is implemented as elongated hole open on one side. This is particularly advantageous if space is limited because the insertion bevels may advantageously be dispensed with in this embodiment.

Depending on the production method, the delimitation of the recess may be implemented using a radius or an angle. Contours that can already be produced when casting the cylinder head are possible, as well.

An exemplary embodiment of a fuel injector according to the present invention and a fuel-injection system according to the present invention, as well as a fuel-injection system are illustrated in the drawing in simplified form and described in greater detail in the following description.

DETAILED DESCRIPTION

Figure 1:
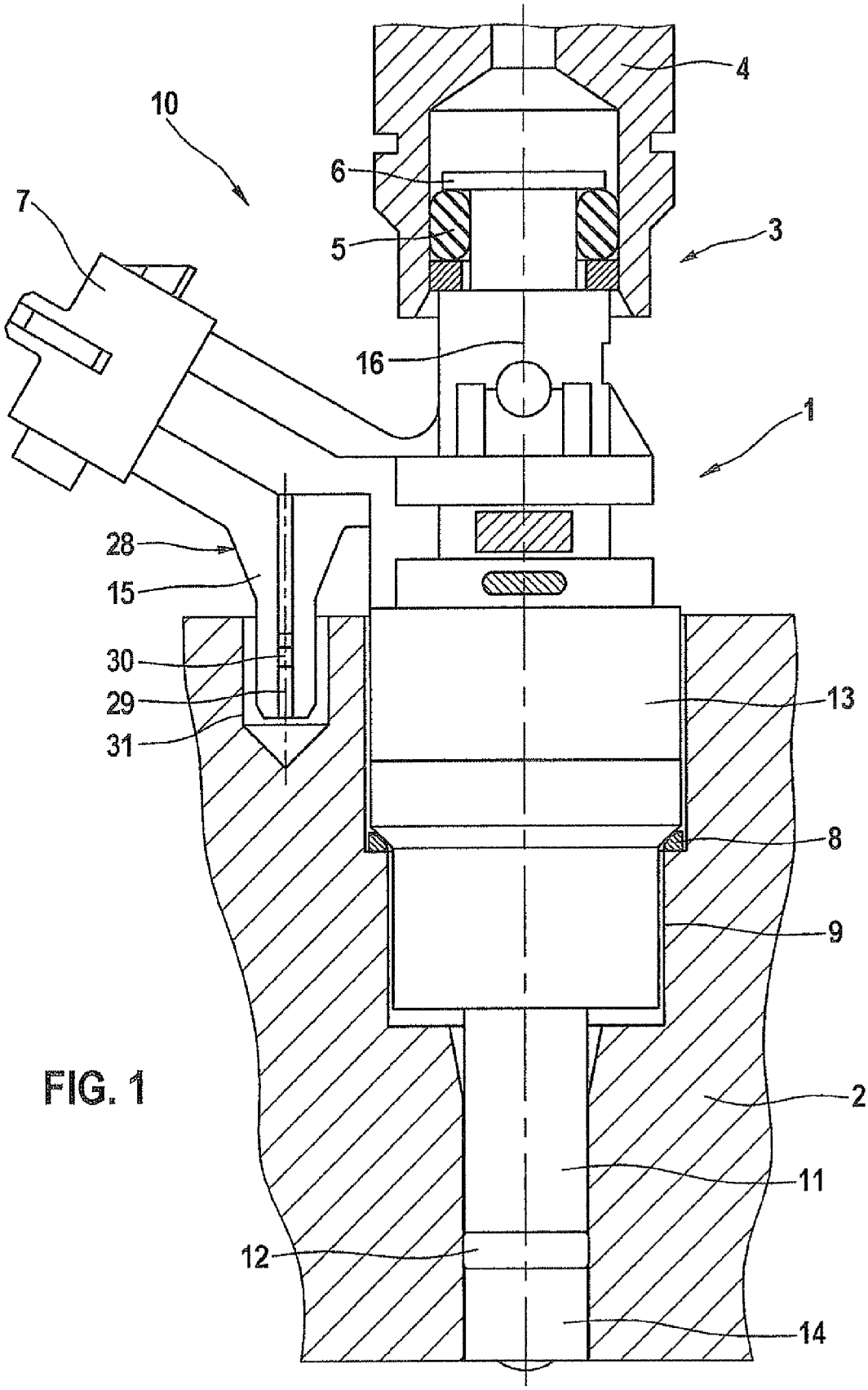
FIG. 1 is a schematic cross-section through a fuel injector provided with an anti-rotation fixation.

FIG. 1 shows a schematic cross section through a fuel injector 1. Fuel injector 1, which is in the form of a directly injecting fuel injector, is installed in a cylinder head 2 of an internal combustion engine.

At an end 3 on the intake side, fuel injector 1 is provided with a plug connection to a fuel-distributor line 4, which is sealed by a seal 5 implemented in the form of an O-ring, between fuel-distributor line 4 and a supply connection 6 of fuel injector 1. Fuel injector 1 has a plug 7 for the electrical contacting to actuate fuel injector 1.

Fuel injector 1 is provided with a washer 8 in a first recess 9 or receiving bore of cylinder head 2, which is utilized as compensating element for fuel injector 1 in receiving bore 9 and compensates manufacturing tolerances of the individual components, e.g., nozzle body 11 or a valve housing 13, as well as temperature-related tolerances.

Figure 2:
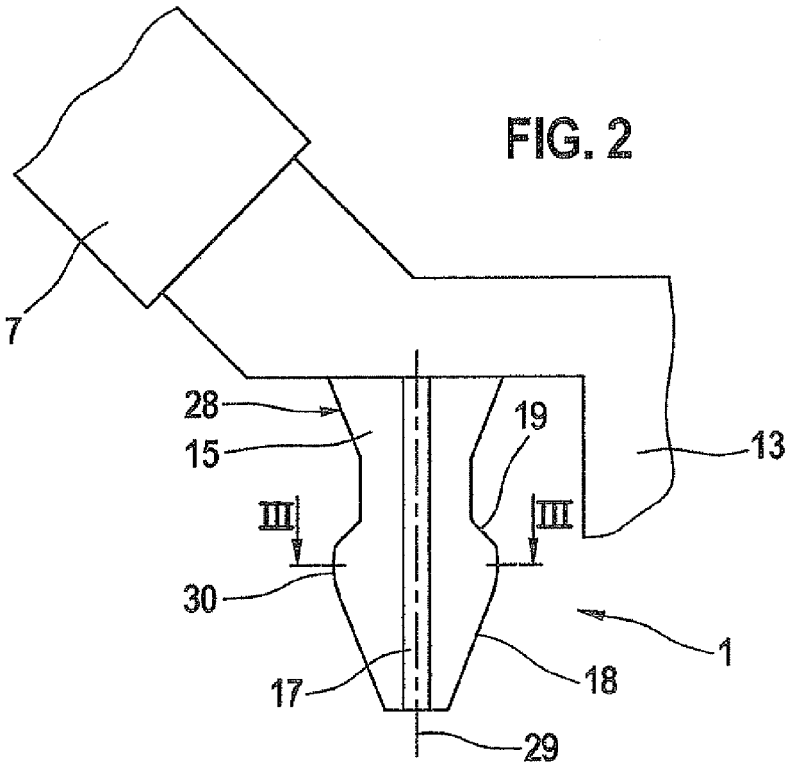
FIG. 2 is a side view of the fixation element according to example embodiments of the present invention.

At a spray-discharge-side end, nozzle body 11 is provided with a sealing ring 12 mounted thereon. The fuel-injection system depicted here constitutes an example in which fuel injector 1 is installed without using an intermediate sleeve to fuel-distributor line 4, but in which there is only one sealing location between fuel-distributor line 4 and fuel injector 1, in the form of an O-ring. Furthermore, this fuel injector 1 sprays along the extension of a longitudinal axis 16 and is not inclined relative thereto. A fixation element 15 extends on the spray-discharge side of a connection region 28 between plug 7 and valve housing 13. Fixation element 15 is accommodated in a second recess or receiving bore 31 in the form of a blind hole in cylinder head 2. A longitudinal axis 29 of fixation element 15 extends coaxially to longitudinal axis 16 of nozzle body 11. A reinforcement in the form of four outwardly projecting elements 30 having a spherical contour is provided on the outer periphery of fixation element 15. The number of outwardly projecting elements 30 is variable, however. Instead of four elements 30, for example, only two, or also more than four, may be provided. Fixation element 15 is extruded as part of a plastic extrusion coat, for instance. FIG. 2 shows a side view of fixation element 15 according to example embodiments of the present invention. Housing 13 is provided with a plastic extrusion coat, which simultaneously forms plug 7 at whose outer periphery an outwardly projecting fixation element 15 is premolded, which has a spherical contour and is used as anti-rotation fixation of the valve in the cylinder head (not shown). For reinforcement purposes, a rib 17 is also provided on the outer periphery of fixation element 15 along longitudinal axis 29, the rib being premolded on fixation element 15 by injection molding.

Fixation element 15 or its spherical contour and elements 30, which project from fixation element 15 in a radially outward direction and form the reinforcement, are designed in such a way that a back taper 19 is provided at their upper end on the inflow side, and that they have an insertion bevel 18 in the form of a continuous taper in the spray-discharge direction of the fuel injector, which facilitates the installation of fuel injector 1. Back taper 19 at the upper end of the spherical contour also prevents jamming of fixation element 15 inside the cylinder-head bore or recess (not shown).

FIG. 3*a* through 3*d* show individual sectional views along line III-III of FIG. 2 of different exemplary embodiments of the anti-rotation fixations or fixation element 15 according to the present invention.

Figure 3A:
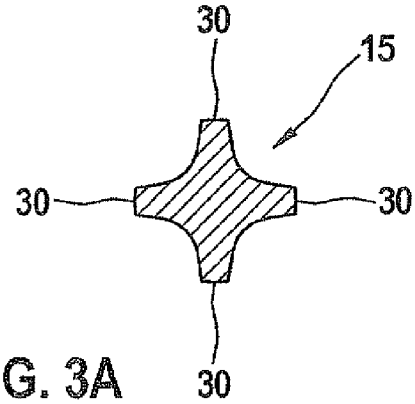
FIG. 3*a*-3*d* are four side views of different exemplary embodiments of fixation elements.

FIG. 3*a* shows an anti-rotation fixation having four outwardly projecting elements 30, which are spaced apart at 90° intervals on the outer periphery of fixation element 15 and therefore form four spherical contours or the reinforcements thereon.

Figure 3B:
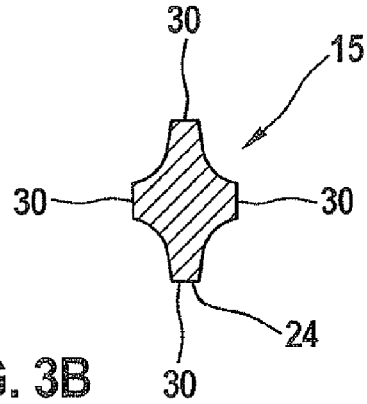

FIG. 3*b* shows an exemplary embodiment that likewise has four outwardly projecting elements 30; however, two diametrically opposed elements in each case differ in the length by which they radially project from fixation element 15 in an outward direction. In contrast to the exemplary embodiment shown in FIG. 3*a*, the outwardly projecting end faces 20 of fixation elements 15 have a planar design, but they may also curve, so that a spherical contour is obtained.

Figure 3C:
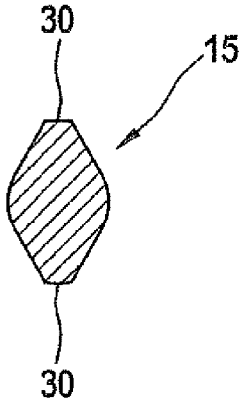

FIG. 3*c* shows an exemplary embodiment in which only two outwardly projecting elements 30 are provided, and the remaining outer surfaces of fixation element 15, which do not have outwardly projecting elements 30, may have any other design.

Figure 3D:
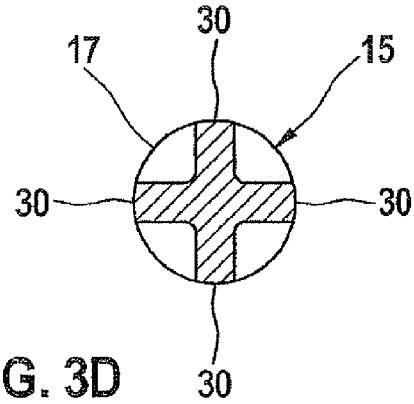

FIG. 3*d* finally shows an exemplary embodiment which is similar to the one shown in FIG. 3*a*, but for which a reinforcement in the form of a transversely extending rib 17 is additionally provided on the outer periphery of fixation element 15.

Figure 4:
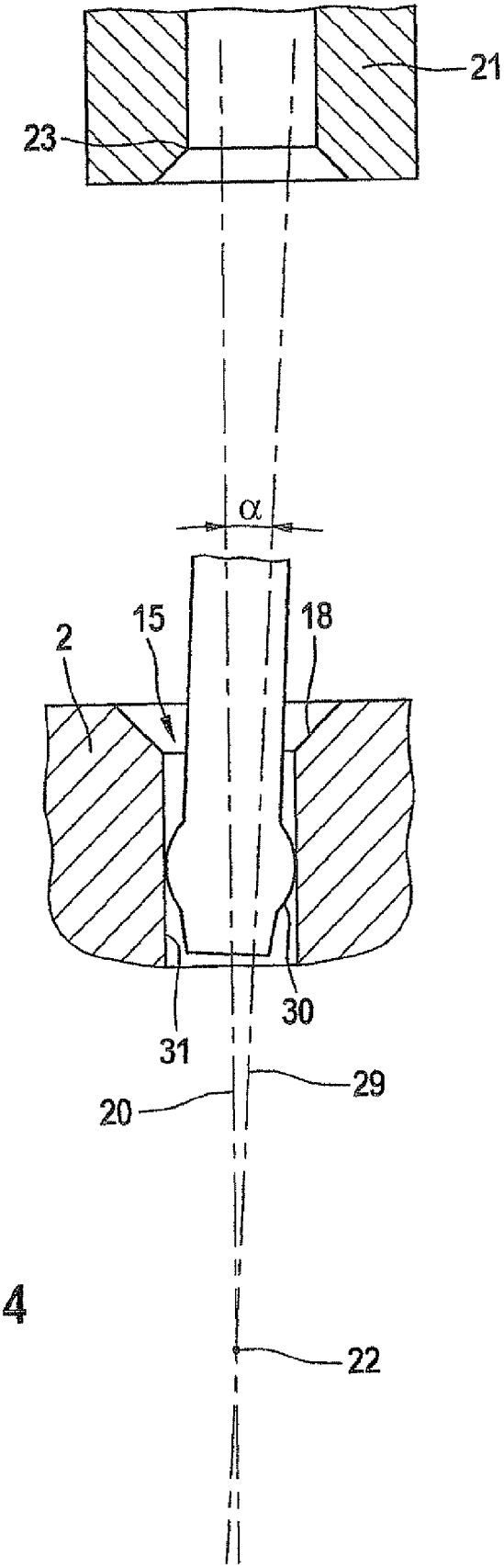
FIG. 4 is a schematic, part-sectional side view of the fixation element according to example embodiments of the present invention.

FIG. 4 schematically illustrates the deviation between longitudinal axis 29 of fixation element 15 and longitudinal axis 20 of second recess 31 of cylinder head 2, the two longitudinal axes forming an angle $\alpha$, which also characterizes the inclination of fuel injector 1 between the pivotal points of position 23 of O-ring 5 in rail cup 21 and the position of combustion-chamber seal 22 in the form of, e.g., a sealing ring 12 (not shown) provided around the outer periphery of nozzle body 11. The anti-rotation fixation of fuel injector 1 in the form of fixation element 15 having a spherical contour engages with recess 31. Because of this configuration according to example embodiments of the present invention, the anti-rotation fixation in recess 31 also inclines in a corresponding tolerance adjustment. If the anti-rotation fixation did not have a spherical contour or did not have a back taper above the spherical contour, then the anti-rotation fixation or fixation element 15 could jam in recess 31 and possibly even break.

FIG. 5*a* through 5*d* show various side views of a section of fixation element 15, whose outer periphery has different developments of anti-rotation fixations or reinforcements or outwardly projecting elements 30.

Figure 5A:
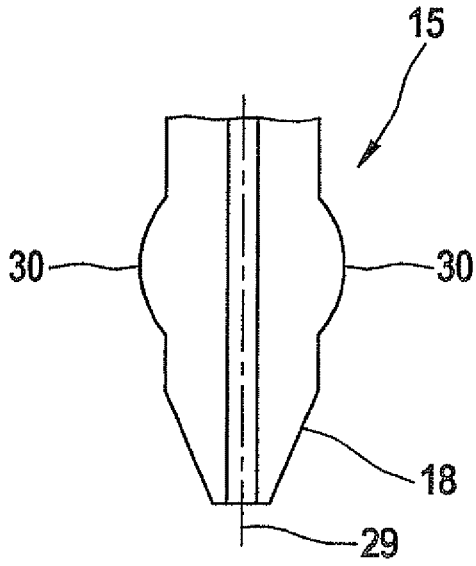
FIG. 5*a*-5*d* are individual side views of a section of the fixation element having a spherical contour.

In FIG. 5*a*, radially outwardly projecting elements 30 having a spherical contour are provided on the outer periphery of fixation element 15.

At the lower end, fixation element 15 has a beveled guide section 18. In contrast, no beveled guide section 18 is provided in the exemplary embodiment shown in FIG. 5*b*, and outwardly projecting elements 30 have a rounded form.

Figure 5B:
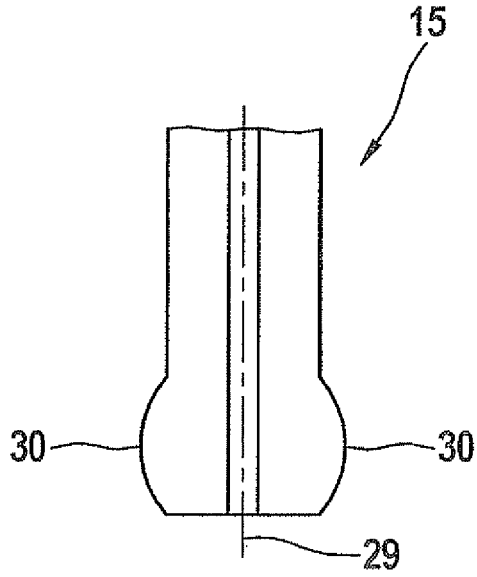
Figure 5C:
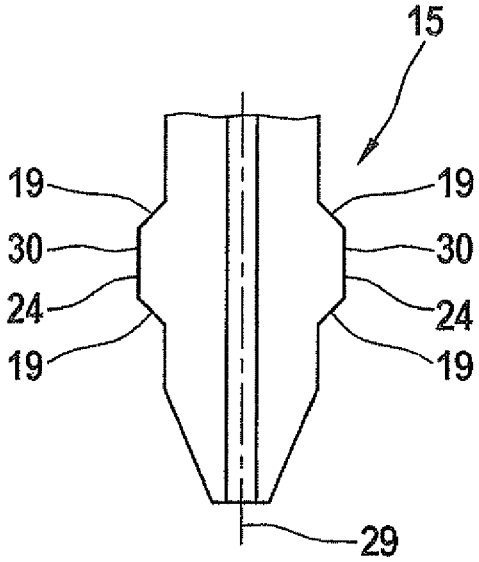

FIG. 5*c* shows an exemplary embodiment in which outwardly projecting elements have a planar design—and not a round design as shown in FIG. 5*b*—at their outer end faces 24, as well as back tapers 19 adjoining above and below outer end faces 24.

Figure 5D:
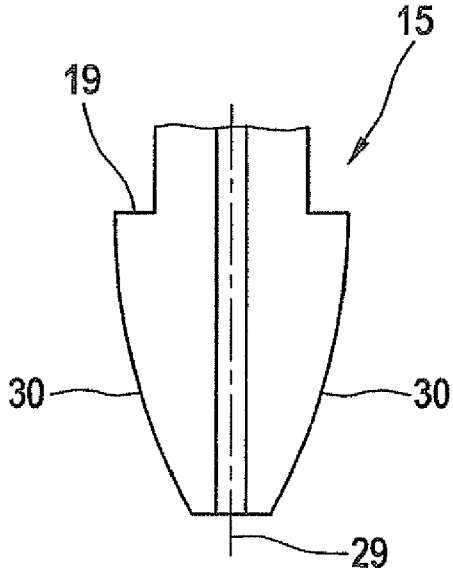

FIG. 5*d* shows another exemplary embodiment in which outwardly projecting elements 30 have a spherical contour, which is elongated in the direction of longitudinal axis 29 of fixation element 15 and which includes a back taper or an offset 19 at the upper end.

Figure 6C:
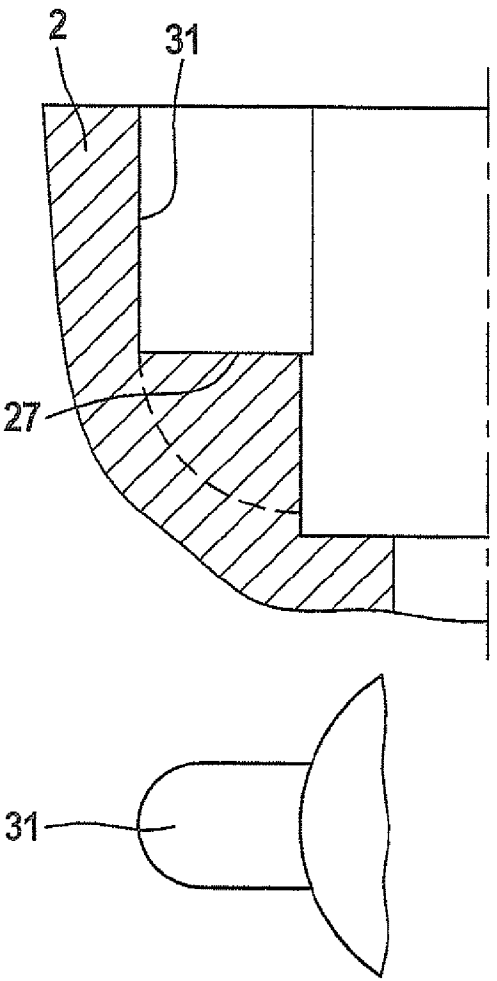
FIG. 6*a*-6*c* are individual sectional views of differently designed recesses in the cylinder head together with associated plan views of the recesses.
Figure 6B:
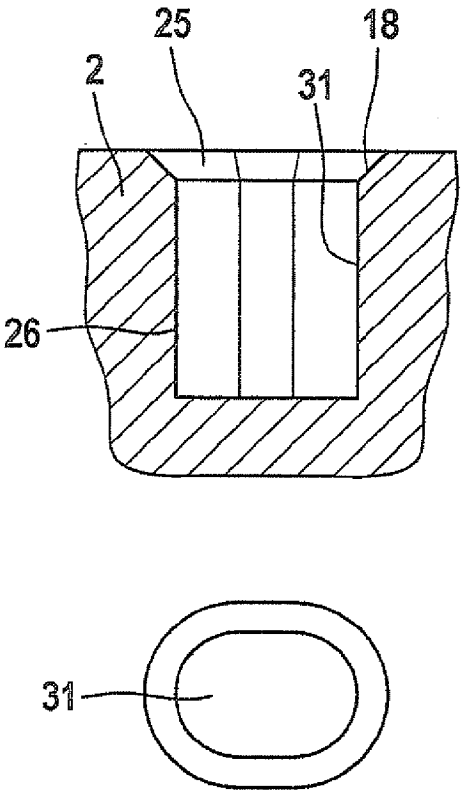
Figure 6A:
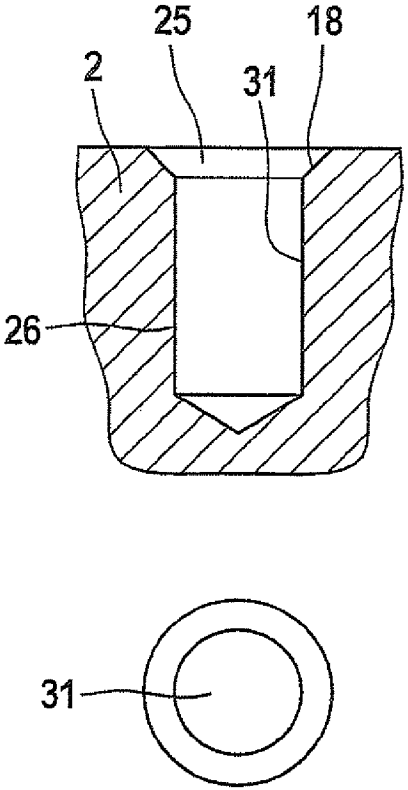

FIG. 6*a* through 6*c* show individual sectional views of differently implemented second recesses 31 in cylinder head 2 together with associated plan views of second recesses 31. In FIG. 6*a*, second recess 31, or the cylinder-head bore, has a round design with which the anti-rotation fixation of fixation element 15 (not shown) engages. Second recess 31 must be considerably larger than the anti-rotation fixation in order to allow a radial movement of fixation element 15 (not shown). Furthermore, second recess 31 has an upper hollow frustoconical section 25 as beveled guide section 18 and an adjoining hollow-cylindrical section 26. FIG. 6*b* shows a second recess 31 with which the anti-rotation fixation (not shown) of fixation element 15 engages and which is implemented in the form of an elongated hole. In this context it is especially advantageous that the required installation play between the cylinder-head bore or recess 31 is independent of the deflection between rail cup 21 and cylinder-head bore 31. This makes it possible to keep the installation play between cylinder-head bore 31 and the anti-rotation fixation constant and especially low (cf. FIG. 7*b*).

Finally, FIG. 6*c* shows another exemplary embodiment in which second recess 31 is realized as elongated hole open on one side. This is advantageous especially if space is limited since beveled guide section 18 may be dispensed with. Depending on the production method, the delimitation of second recess 31 may be implemented using a radius (denoted by the dashed line) or an angle having a step 27.

Figure 7A:
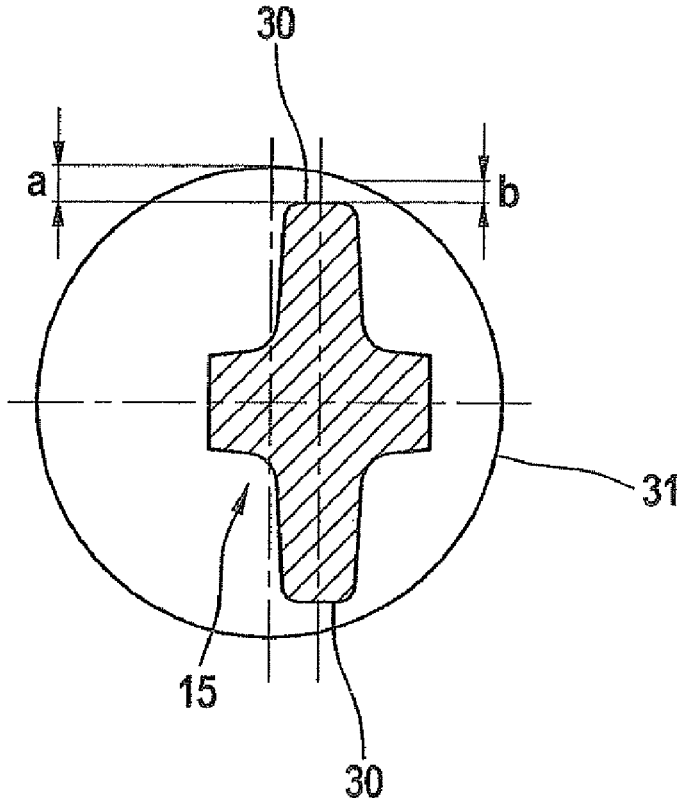
FIG. 7*a*, 7*b* are sectional views of an exemplary embodiment of an anti-rotation fixation in a round cylinder-head bore or recess, and in a recess designed in the form of an elongated hole.
Figure 7B:
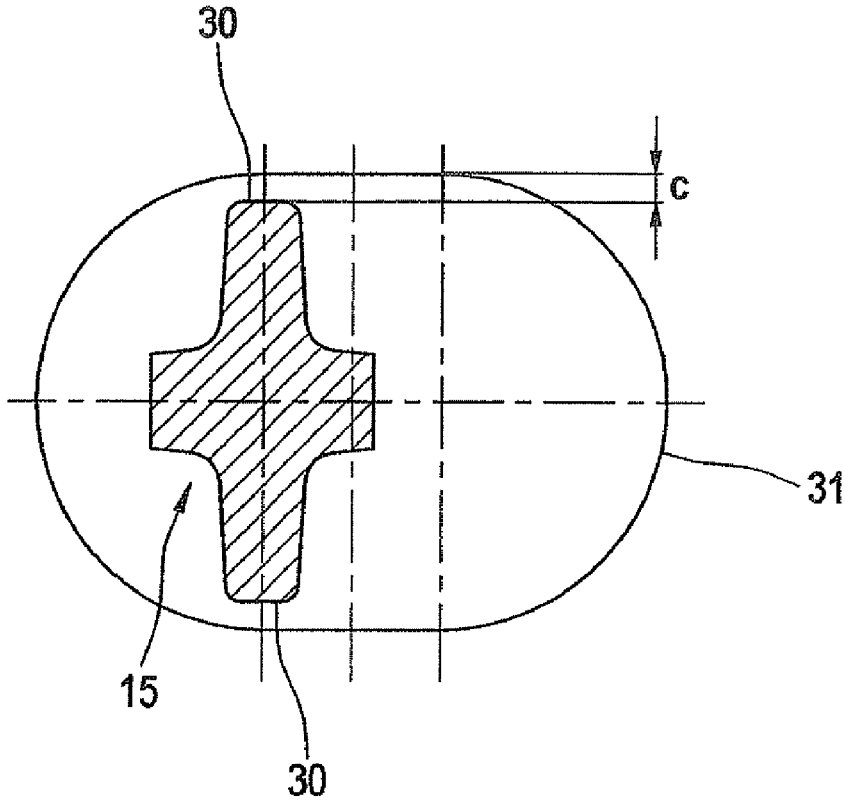

FIGS. 7*a* and 7*b* illustrate the different installation plays that exist at outwardly projecting elements 30 formed on fixation element 15, between a round recess 31 and a recess 31 in the form of an elongated hole. As illustrated by distance a, there a considerable play in the center position, which results in great spray deviation, which is also not constant when fuel injector 1 is in a tilted position, as indicated by distance d. As can be seen there, the installation play is greater in the center position than in the inclined position. This is not the case if recess 31 is in the form of an elongated hole (FIG. 7*b*). In this case, the installation play, which is denoted by distance c, remains constant both in the center position and in the inclined position.

What is claimed is:

1. A fuel injector, comprising:

a nozzle body adapted to be inserted into a recess of a cylinder head, a valve housing;

a plug abutting the valve housing; and at least one fixation device adapted to fix the nozzle body in position in the recess, the fixation device extending from a connection region between the valve housing and the plug on a spray-discharge side, wherein the at least one fixation device includes a reinforcement on an outer periphery, the reinforcement being formed by at least one outwardly projecting element having at least one of (a) an outwardly curving end face and (b) a planar end face.

2. The fuel injector according to claim 1, wherein the fuel injector is adapted for direct injection of fuel into a combustion chamber of an internal combustion engine.

3. The fuel injector according to claim 1, wherein the valve housing is provided with a plastic extrusion coat, which simultaneously forms the plug, the fixation device being premolded on the plastic extrusion coat.

4. The fuel injector according to claim 1, wherein the fixation device includes two reinforcements on the outer periphery, in the form of outwardly projecting elements, which are formed on opposite sides on the fixation device.

5. The fuel injector according to claim 3, wherein four outwardly projecting elements are formed at intervals of 90° on the outer periphery of the fixation device.

6. The fuel injector according to claim 3, wherein the at least one fixation device is arranged in the form of an injection-molded pin.

7. The fuel injector according to claim 1, wherein a back taper is provided above a contour of the at least one outwardly projecting element in a direction of an inflow-side end of the fuel injector.

8. The fuel injector according to claim 1, wherein a contour of the element has a continuous taper in a direction of a spray-discharge side of the fuel injector.

9. The fuel injector according to claim 3, wherein a rib arranged as a reinforcement is provided on the outer periphery of the fixation device.

10. The fuel injector according to claim 9, wherein the fuel injector is sealed from a rail cup of a fuel-distributor line by an O-ring.

11. The fuel injector according to claim 1, wherein the fuel injector is arranged as a multi-hole valve having asymmetrically distributed spray orifices.

12. The fuel injector according to claim 1, wherein a fuel jet spray-discharged through spray orifices is inclined relative to a longitudinal valve axis.

13. A fuel-injection system, comprising:

a cylinder head including at least one recess; and at least one fuel injector including:

a nozzle body adapted inserted into the recess of the cylinder head, a valve housing;

a plug abutting the valve housing; and at least one fixation device adapted to fix the nozzle body in position in the recess, the fixation device extending from a connection region between the valve housing and the plug on a spray-discharge side, wherein the at least one fixation device includes a reinforcement on an outer periphery, the reinforcement being formed by at least one outwardly projecting element having at least one of (a) an outwardly curving end face and (b) a planar end face;

wherein a second recess is provided in the cylinder head to accommodate a fixation element, which is in the form of an elongated hole.

14. The system according to claim 13, wherein the elongated hole is in the form of an elongated hole open on one side.

15. The system according to claim 13, wherein the second recess has a hollow frustoconical form in at least one section to provide a beveled guide section.

16. The system according to claim 13, wherein the second recess has a hollow cylindrical form in at least one section.

17. The system according to claim 13, wherein, at an inflow-side end, the fuel injector is connected to a rail cup of a fuel-distributor line.

18. The system according to claim 13, wherein the at least one fixation device engages with an inner wall of the second recess.

* * * * *